US006059604A

United States Patent [19]

Juntwait et al.

[11] Patent Number: 6,059,604

[45] Date of Patent: May 9, 2000

[54] CABLE ASSEMBLY WITH GROUNDING CONDUCTORS CONNECTED TO GROUNDING PLANE

[75] Inventors: Eric Juntwait, Irvine, Calif.; George Lee, Taipei, Taiwan

[73] Assignee: Hon Hai Precision Ind. Co., Ltd., Taipei Hsein, Taiwan

[21] Appl. No.: 09/222,168

[22] Filed: Dec. 28, 1998

[51] Int. Cl.[7] ..... H01R 12/24

[52] U.S. Cl. ..... 439/497; 439/404

[58] Field of Search ..... 439/497, 404, 439/98, 499

[56] References Cited

U.S. PATENT DOCUMENTS

| | | | |
|---|---|---|---|
| 4,005,921 | 2/1977 | Hadden et al. | 439/497 |
| 4,027,941 | 6/1977 | Narozny | 439/497 |
| 4,073,560 | 2/1978 | Anhalt et al. | 439/404 |
| 4,094,564 | 6/1978 | Cacolici | 439/497 |
| 4,260,209 | 4/1981 | Zell et al. | 439/497 |
| 4,310,208 | 1/1982 | Webster et al. | 439/497 |
| 4,365,856 | 12/1982 | Yaegashi | 439/497 |

*Primary Examiner*—Paula Bradley
*Assistant Examiner*—Tho D. Ta
*Attorney, Agent, or Firm*—Wei Te Chung

[57] ABSTRACT

A cable assembly comprising an insulation displacement contact (IDC) connector which includes a dielectric housing having front and rear faces. An array of passageways is defined between the front and rear faces and each passageway securely receiving a terminal therein. Each the terminal forms an insulation displacement section extending beyond the rear face. A ground plane cable is assembled to the rear face of the housing and includes signal and ground wires. The signal wires are terminated to the IDC connector by a cover and the ground wires are soldered to a ground plane of the cable.

3 Claims, 4 Drawing Sheets

CABLE ASSEMBLY WITH GROUNDING CONDUCTORS CONNECTED TO GROUNDING PLANE

FIELD OF THE INVENTION

The present invention relates to a method, and more particularly to a method for connecting specific conductors to a ground plane.

DESCRIPTION OF PRIOR ART

As signal transmission speed in cable assemblies increases, the need to isolate and protect the signals from electrical noise becomes important. One existing method for achieving this is performed by using a ground plane ribbon cable which includes a ground plane attached to conductive wires. The ground plane acts as a barrier to shield the signal within the conductive wires from being influenced by noise. In addition, a certain number of conductive wires within the cable are grounded to ensure proper signal transmission.

SUMMARY OR THE INVENTION

An objective of this invention is to provide a method for connecting specific conductors of a ribbon cable to a ground plane thereby ensuring noise-free signal communication.

In order to achieve the objective set forth, a method for connecting specific conductors to a ground plane of a ribbon cable comprises: Step a) splitting the ribbon cable end into discrete wires. Step b) clipping off a plurality of selected signal conductors while leaving unselected ground conductors intact. Step c) terminating the signal conductors at insulation displacement sections of an IDC connector with the unselected ground conductors extending outward from the IDC connector. Step d) soldering the unselected ground conductors to the ground plane.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

Figure 1:
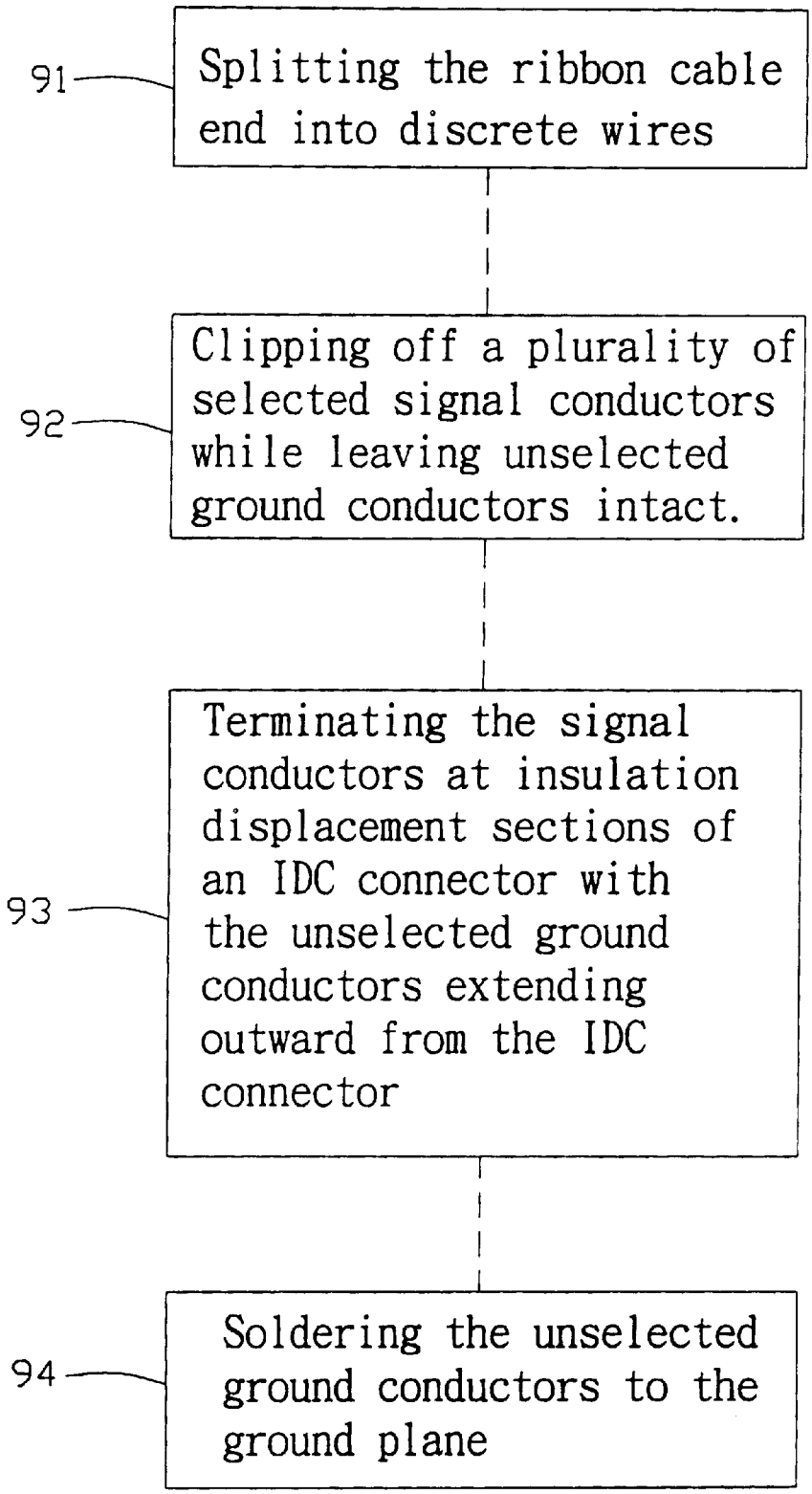
FIG. 1 is a flow chart of a connecting process for connecting ground conductors to a ground plane of a ribbon cable.

Referring to FIG. 1, a method for connecting specific conductors to a ground plane of a ribbon cable comprises: Step 91, splitting the ribbon cable end into discrete wires. Step 92, clipping off a plurality of selected signal conductors while leaving unselected ground conductors intact. Step 93, terminating the signal conductors at insulation displacement sections of an IDC connector with the unselected ground conductors extending outward from the IDC connector. Step 94, soldering the unselected ground conductors to the ground plane.

Figure 2:
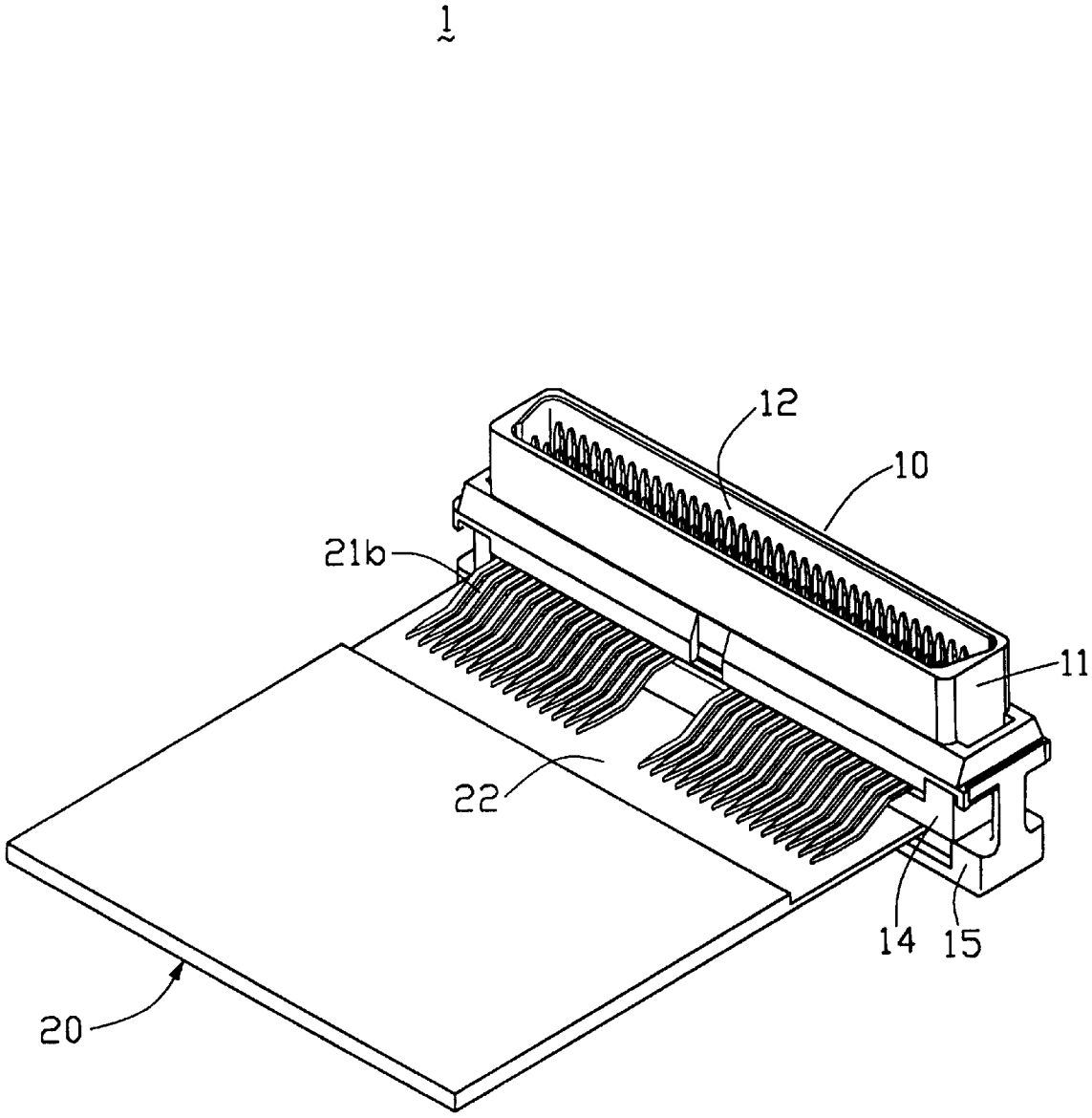
FIG. 2 is a perspective view of an IDC connector in accordance with the present invention.
Figure 3:
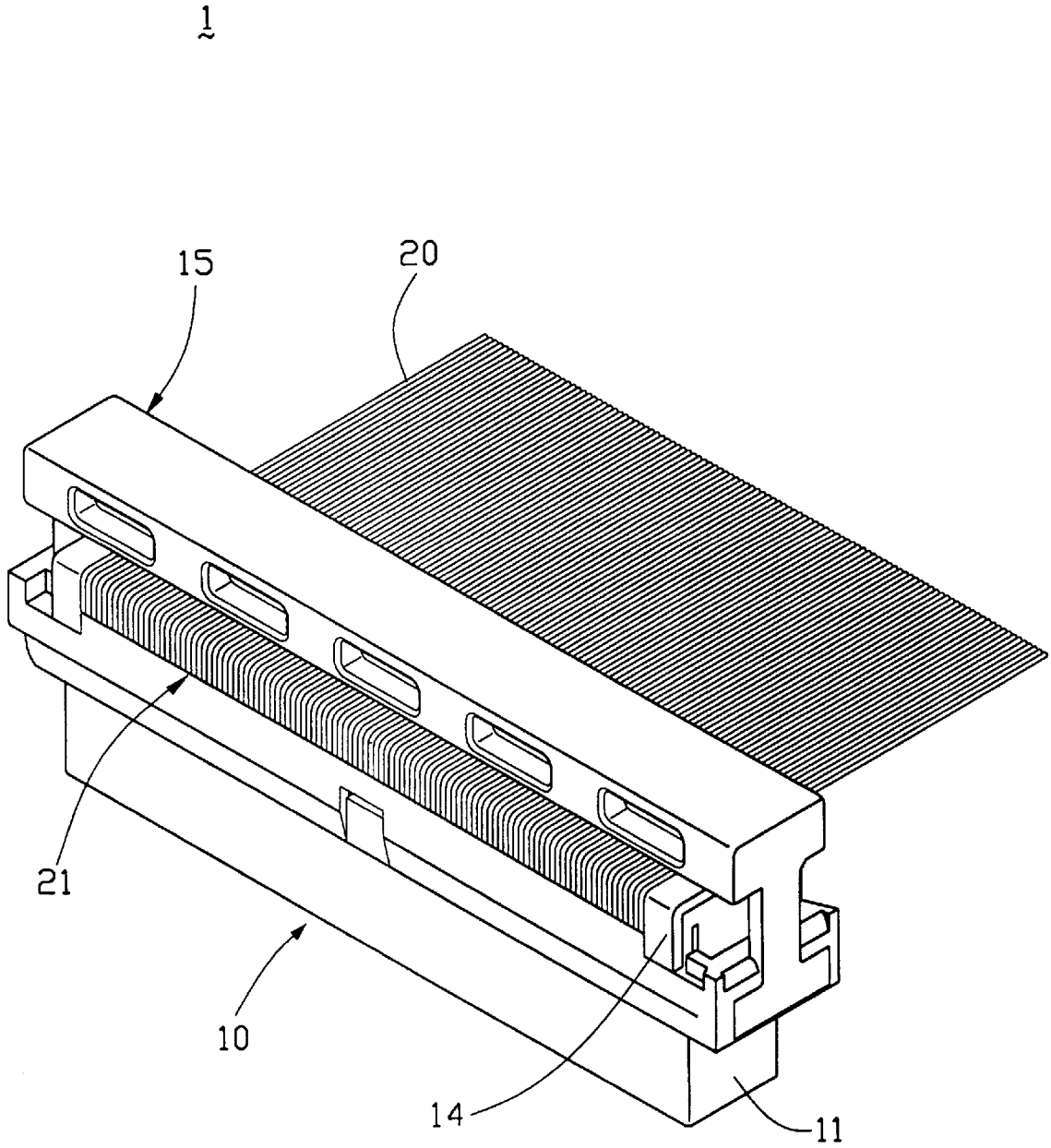
FIG. 3 is similar to FIG. 2 but viewed from a reverse angle.

Referring to FIGS. 2 and 3, a cable assembly 1 in accordance with the present invention comprises an IDC connector 10 including a dielectric housing 11 having front and rear faces (not labeled). An array of passageways (not labeled) is defined between the front and rear faces. Each passageway securely receives a terminal (not labeled) therein. Each terminal forms an insulation displacement section extending beyond the rear face and a pin section 12 extending beyond the front face.

A ground plane cable 20 is assembled to the rear face of the housing 11. An end of the cable 20 is split into discrete wires 21 wherein the signal wires are clipped off at a certain length while ground wires 21*b* are left intact. The signal wires and the ground wires 21*b* are terminated by a first cover 14 assembled to the IDC connector 10. Extensions (not labeled) of the ground wires 21*b* are then soldered to a ground plane 22 of the cable 20 thereby ensuring the grounding effect thereof. A second cover 15 is assembled to the housing 11 thereby securely pressing the cable 20 to the first cover 14. Accordingly, connections between the conductors and the insulation displacement sections are prevented from having excess force exerted thereon.

Figure 4:
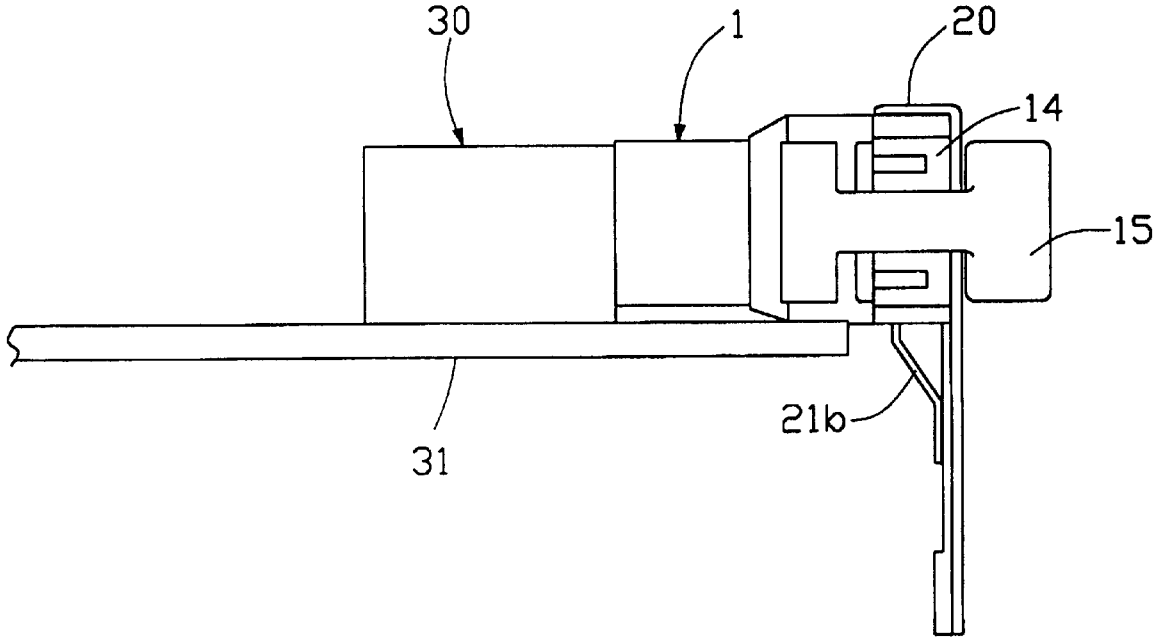
FIG. 4 is a side elevation view of the IDC connector assembled to a printed circuit board.

FIG. 4 shows an application of the cable assembly 1 assembled to a receptacle connector 30 securely assembled on a printed circuit board 31.

Although the present invention has been described with reference to preferred embodiment thereof, it is apparent to those skilled in the art that a variety of modifications and changes may be made without departing from the scope of the present invention which is intended to be covered by the appended claims.

We claim:

1. A cable assembly, comprising:

an insulation displacement contact (IDC) connector, including:

a dielectric housing having front and rear faces, an array of passageways being defined between said front and rear faces, each passageway securely receiving a terminal therein, each said terminal forming an insulation displacement section extending beyond said rear face and a pin section extending toward said front face;

a ground plane ribbon cable having a ground plane attached to a plurality of signal and ground wires thereof, said cable assembled to said rear face of the housing, an end of said cable being split into discrete wires wherein said signal wires are clipped off while said ground wires are left intact, said signal wires are terminated by a cover assembled to said IDC connector and said ground wires are soldered to said ground plane of said cable.

2. A cable assembly, comprising:

an insulation displacement contact (IDC) connector, including:

a dielectric housing having front and rear faces, a plurality of terminals positioned between said front and rear faces, each of said terminals forming an insulation displacement section around the rear face;

a ground plane ribbon cable assembled to the rear face of the housing and including a ground plane attached to a plurality of signal wires and ground wires thereof, wherein the cable extends into the housing from one side of the housing and has only the ground wires extend out of the housing and said outward extending ground wires are soldered to a portion of the ground plane exposed to an exterior with respect to the connector.

3. The cable assembly as recited in claim 2, wherein an outermost cover is attached to the housing to sandwich said terminated cable between the housing and the cover, and both of the cable and the ground wires extend outward from the connector on the same side of the housing for facilitating soldering the ground wires unto the ground plane of the cable.

* * * * *